United States Patent [19]

Bakermans

[11] Patent Number: 4,531,280

[45] Date of Patent: Jul. 30, 1985

[54] MODULAR UNIT ASSEMBLY MACHINE

[75] Inventor: Johannes C. W. Bakermans, Harrisburg, Pa.

[73] Assignee: AMP Incorporated, Harrisburg, Pa.

[21] Appl. No.: 623,934

[22] Filed: Mar. 26, 1979

[51] Int. Cl.[3] ..... H01R 43/00

[52] U.S. Cl. ..... 29/564.6; 227/96

[58] Field of Search ..... 29/33 M, 564.1, 564.6, 29/566.2, 56.6, 747, 759, 884; 227/96

[56] References Cited

U.S. PATENT DOCUMENTS

| | | | |
|---|---|---|---|
| Re. 26,646 | 8/1969 | Evans . | |
| Re. 26,837 | 3/1970 | Evans . | |
| 3,293,735 | 12/1966 | Lovendusky | 29/564.6 X |
| 3,497,939 | 3/1970 | De Saint-Pierre et al. . | |
| 3,576,063 | 4/1971 | Bakermans | 29/747 X |
| 3,699,631 | 10/1972 | Shughart . | |
| 3,769,681 | 11/1973 | Eubank | 29/747 X |
| 3,852,866 | 12/1974 | Johnson | 29/56.6 |
| 4,099,316 | 7/1978 | Morgan et al. | 29/33 M |

*Primary Examiner*—Z. R. Bilinsky
*Attorney, Agent, or Firm*—Russell J. Egan

[57] ABSTRACT

A modular insertion unit is disclosed for use in an assembly machine for sequentially inserting electrical terminals into respective cavities of connector housings. The assembly machine has a drive means, a control module, an indexing means, and a dereeling mechanism. The modular insertion unit is connected to the machine singly or in groups, on one or both sides of a terminal strip feed path. Each modular insertion unit has a housing adapted to be selectively positioned on the assembly machine and is connected to be driven by the drive means. A terminal feed means portion of the modular insertion unit is actuated by the drive means to feed a strip of terminals from the dereeling mechanism to a severing station within the unit where a terminal is clamped, severed from carrier strips, moved to an insertion position and stuffed into a respective cavity of a connector housing. The housing is indexed with respect to the stuffing station until all cavities thereof are filled.

13 Claims, 11 Drawing Figures

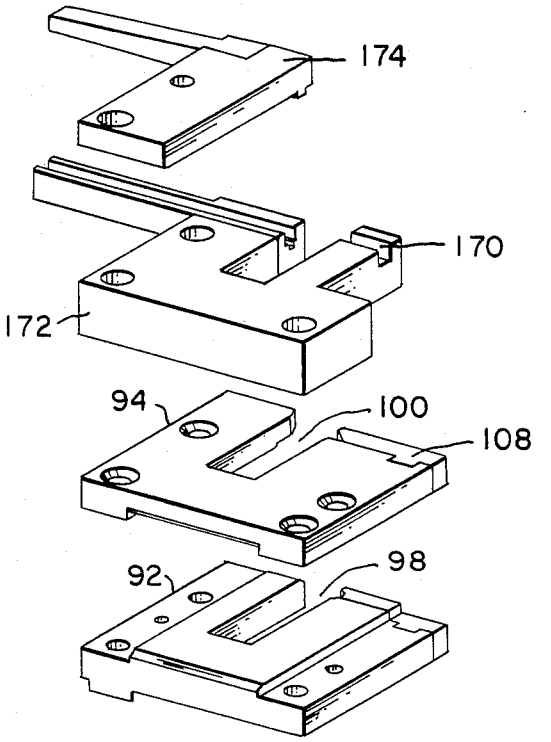
FIG. 4
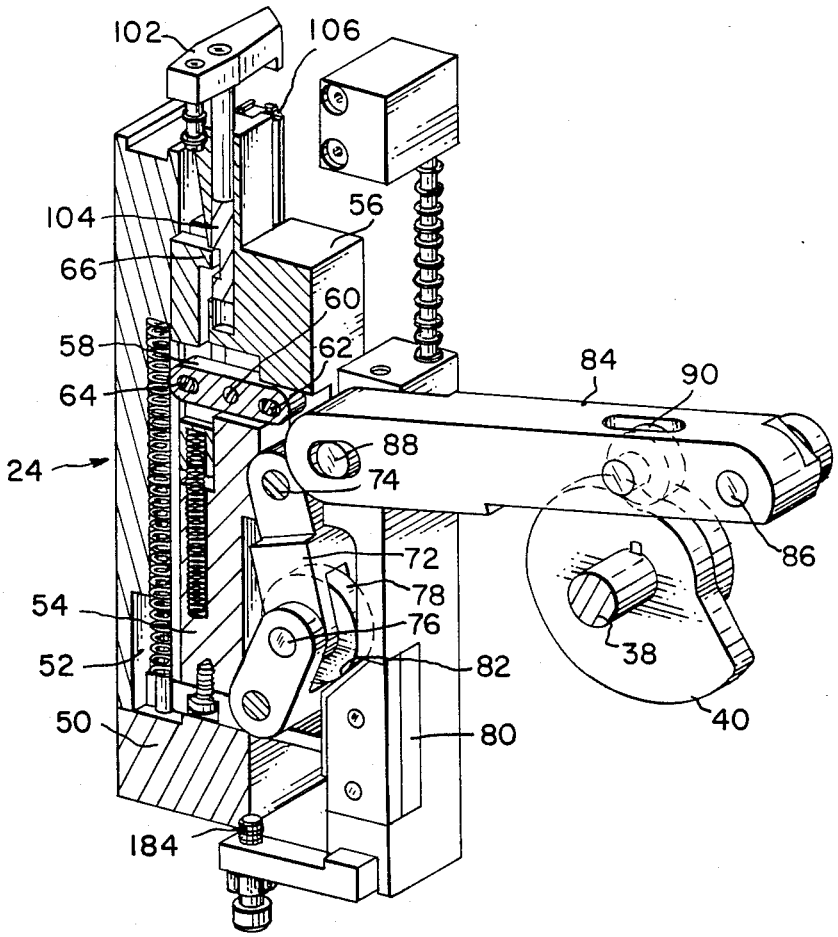

MODULAR UNIT ASSEMBLY MACHINE

BACKGROUND OF THE INVENTION

1. The Field of the Invention

The present invention relates to an electrical connector assembly machine and in particular to a modular insertion unit to be used singly or in combinations on such a machine.

2. The Prior Art

It is common practice to manufacture certain types of electrical terminals by stamping and forming the terminals from a continuous web of metal with the resulting terminals being temporarily joined by one or more carrier strips. The strips of terminals can be fed to automatic machinery which will sequentially cut the individual terminals from their carrier strips and insert the terminals into respective cavities in appropriate connector housings. A variety of assembly machines are known for severing such terminals from the carrier strip and inserting them into connector housings. Most of these known types of assembly machines which are adapted to remove terminals from carrier strips and insert them into connector housings have one or more comparative shortcomings which limit their usefulness in one respect or another. For example, many of the known types of terminal inserters are relatively complex and, therefore, expensive to produce and maintain. Such machines can be used only where the volume of work performed justifies the high investment required. One known type of machine performs the inserting operation by shearing a terminal from the carrier strip and driving the terminal into a housing by means of a ram. A comparative shortcoming of this type of machine is that the terminal is not subject to close control during its movement. This lack of control can cause jamming to occur, particularly with certain types of terminals. This type of machine is usually sufficiently complex that an expert mechanic is needed to clear and, if necessary, reset the machine to get it into operating condition again. This is very costly in that not only is an expert mechanic required, but there is a substantial amount of down time incurred during which the assembly machine is not operating. This all goes towards driving production costs up a substantial amount.

SUMMARY OF THE INVENTION

The present modular insertion unit is used in an assembly machine for sequentially inserting electrical terminals into respective cavities of connector housings and overcomes many of the above discussed problems of the prior art. The assembly machine has a power source, a control module, an indexing means, a dereeling mechanism, and take-up means. The modular insertion unit is mounted on the assembly machine, singly or in groups, along the terminal feed path. Each modular insertion unit has a housing adapted to be selectively positioned on the assembly machine with respect to the terminal strip feed path. Drive means connect the modular unit to the power source of the machine. The modular insertion unit includes terminal feed means powered by the drive means to feed a strip of terminals from the dereeling mechanism to a severing station. Terminal clamping and severing means hold a terminal in position while severing it from its carrier strips and move the clamped terminal to a stuffing position. Arm means at the stuffing position drive the terminal into a respective cavity in an associated connector housing.

It is therefore an object of the present invention to produce a modular insertion unit for use on an electrical connector assembly machine which unit can be readily replaced for repair at a central facility while a replacement unit keeps the assembly machine operational.

It is another object of the present invention to produce a modular insertion unit which can be used singly or in combination on an electrical connector assembly machine for inserting terminals from one or more strips of terminals into one or more rows of connector cavities.

It is another object of the present invention to produce a modular insertion unit for electrical connector assembly machines which will feed terminals from a dereeling mechanism, sequentially clamp the terminals, sever them from their carrier strips, and insert the freed terminals into respective cavities of a connector housing.

It is a further object of the present invention to produce a modular insertion unit which functions as a sealed unit readily attached to and detached from a main assembly machine with no maintenance being performed at the assembly machine.

It is a still further object of the present invention to produce a modular insertion unit for use on a machine for assembling terminals into electrical connector housings, which insertion unit can be readily and economically manufactured.

The means for accomplishing the foregoing and other objects of the present invention will become apparent to those skilled in the art from the following detailed description taken with reference to the accompanying drawings.

BRIEF DESCRIPTION OF THE DRAWINGS

FIG. 4 is an exploded perspective view taken in section along line 4—4 of FIG. 3;

DETAILED DESCRIPTION OF THE PREFERRED EMBODIMENT

Figure 1:
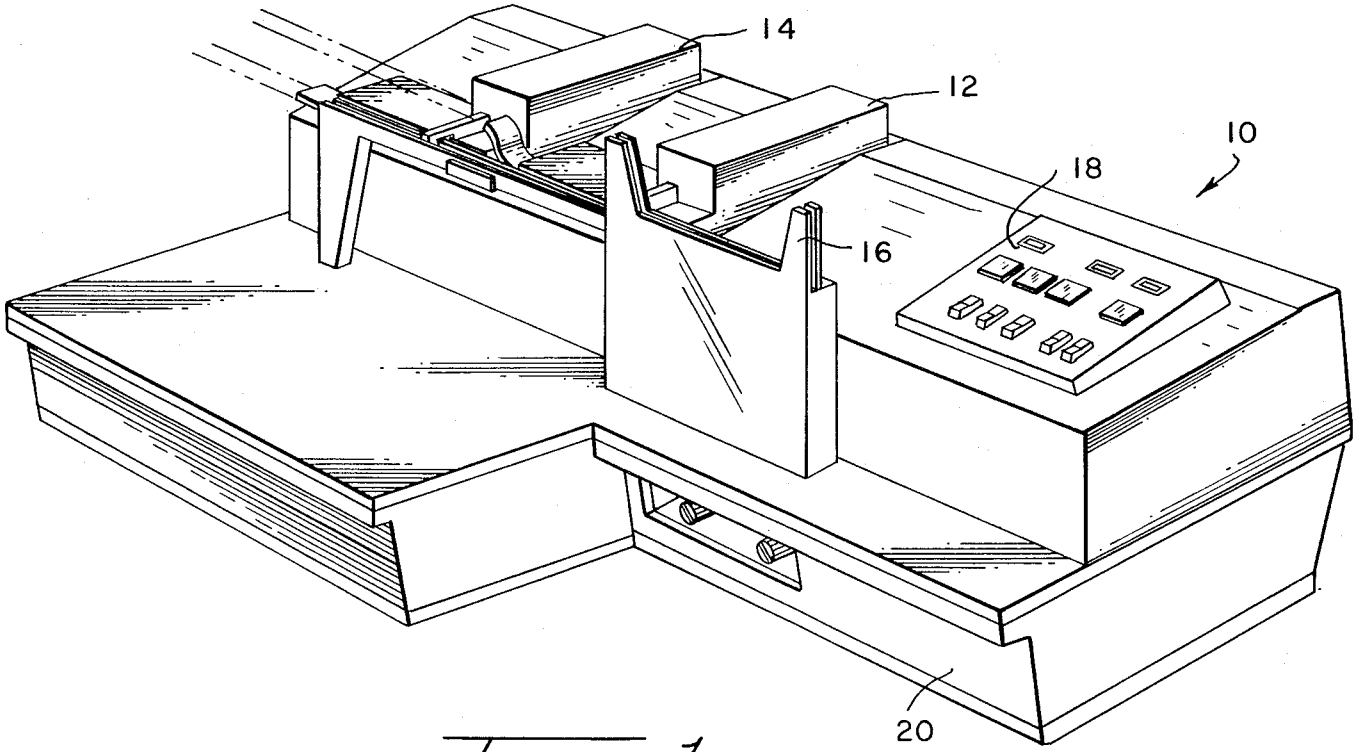
FIG. 1 is a perspective view of an electrical connector assembly machine including a pair of modular insertion units according to the present invention.
Figure 11:
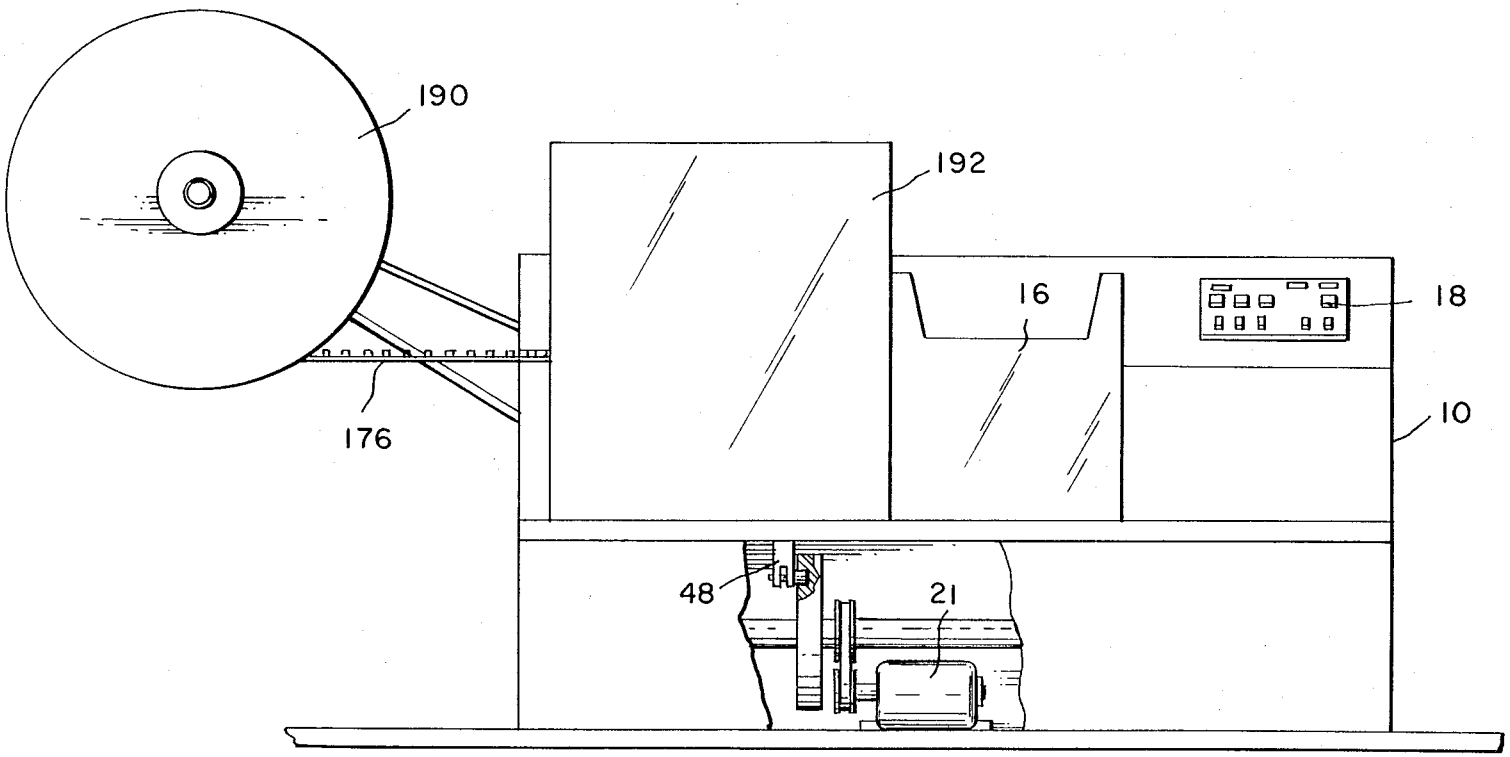
FIG. 11 is a front elevation of an electrical connector assembly machine incorporating the modular insertion units of the present invention.

An electrical connector assembly machine 10 is shown in FIG. 1 having two modular insertion units 12, 14 according to the present invention in aligned spaced condition, an indexing unit 16, and a control panel 18, all on a base 20 which houses a power source 21. Shown in FIG. 11 incorporated in the machine are well known terminal strip dereeling equipment 190 and connector housing feed equipment 192 leading to the indexing unit 16 as well as receptacles for the completed housings and take up for scrap from the terminal carrier strip.

Each of the modular insertion units 12, 14 is a self contained unit which is adapted to be placed on the base 20 and connected to the drive means with only minimal requirements for maintenance and exchange time. Each of the modular insertion units includes three basic assemblies, namely, the cam drive means 22, the terminal severing means 24, the terminal feed means 26, and the terminal stuffing means 28. Each of these means is incorporated in or mounted on a housing 30 having side plates 32, 34 defining a cavity 36. The cam drive means 22 is mounted within the cavity 36 and includes a main drive shaft 38 which is mounted in the housing 30 by suitable bearings (not shown). Fixed to the drive shaft 38 is a first cam 40, a second cam 42, a cog gear 44, and a third cam 46. The third cam 46 is actually outside of the side wall 34. A rack 48 is positioned to engage the cog gear 44 and to be driven with a vertical motion by the drive means (not shown) within the base 20.

The terminal severing means 24 (see FIGS. 2 and 4) includes a stop block 50 which is fixed with respect to the housing 30 and defines a chamber 52 in which a bottom block 54 and a top block 56 are mounted. The blocks are connected by a first link 58 which is pivoted intermediate its ends by pin 60 to the bottom block 54 and at one end by pin 62 to the top block 56. The other end of the link 58 is pivoted by pin 64 to pull member 66. A second link 68 is pivotably connected to the bottom block by pin 70 and a third link 72 is pivotally connected by pin 74 to the top block 56. The opposite ends of the second and third links 68, 72 are pivotably connected together by pin 76 which also connects a cam follower 78 to the links. A cam plate 80 is mounted in housing 30 for vertical movement and includes a cam surface 82 which engages the cam follower 78. The cam plate 80 is moved by lever 84 which has one end fixed to the housing by pivot pin 86, the other end connected to the cam plate 80 by pin 88 and an intermediate cam follower 90 which rides on the cam surface of the first cam 40. The terminal severing means 24 also includes a bottom cutting block 92 and top cutting block 94 which together define a horizontal terminal strip passage 96 (FIG. 2) and vertical terminal passages 98, 100 (FIG. 4). The terminal severing means 24 also includes a clamping plate 102 which has a depending leg portion 104 (FIG. 4) which is engaged by the pull member 66. The top cutting block 94 carries a shear blade 106 on the upper free end aligned with the terminal passages 98, 100 and adopted to cooperate with the shear blade 108 fixed on the top cutting block 94.

Figure 3:
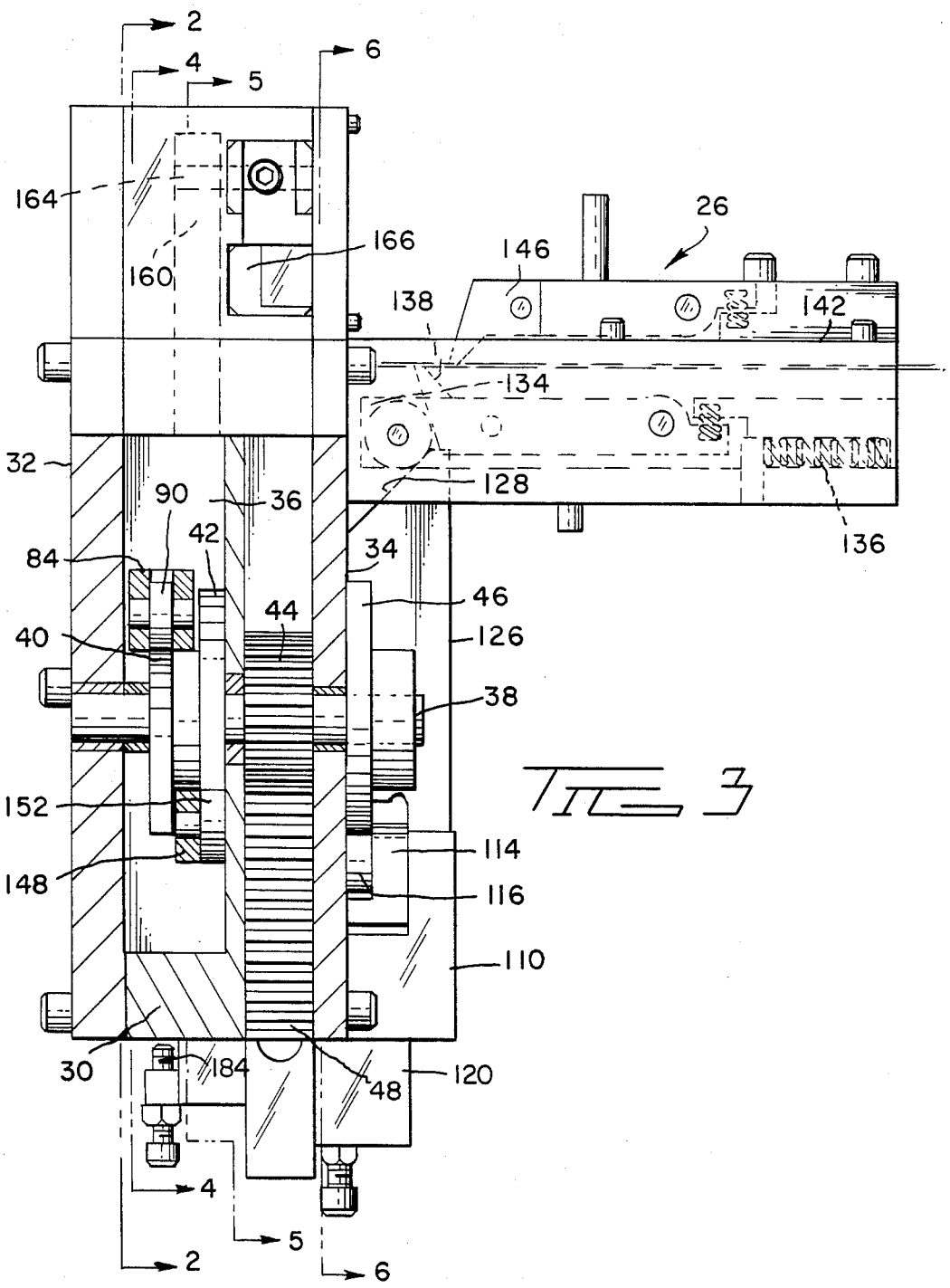
FIG. 3 is a transverse vertical section of the subject modular insertion unit taken along line 3—3 of FIG. 2.
Figure 6:
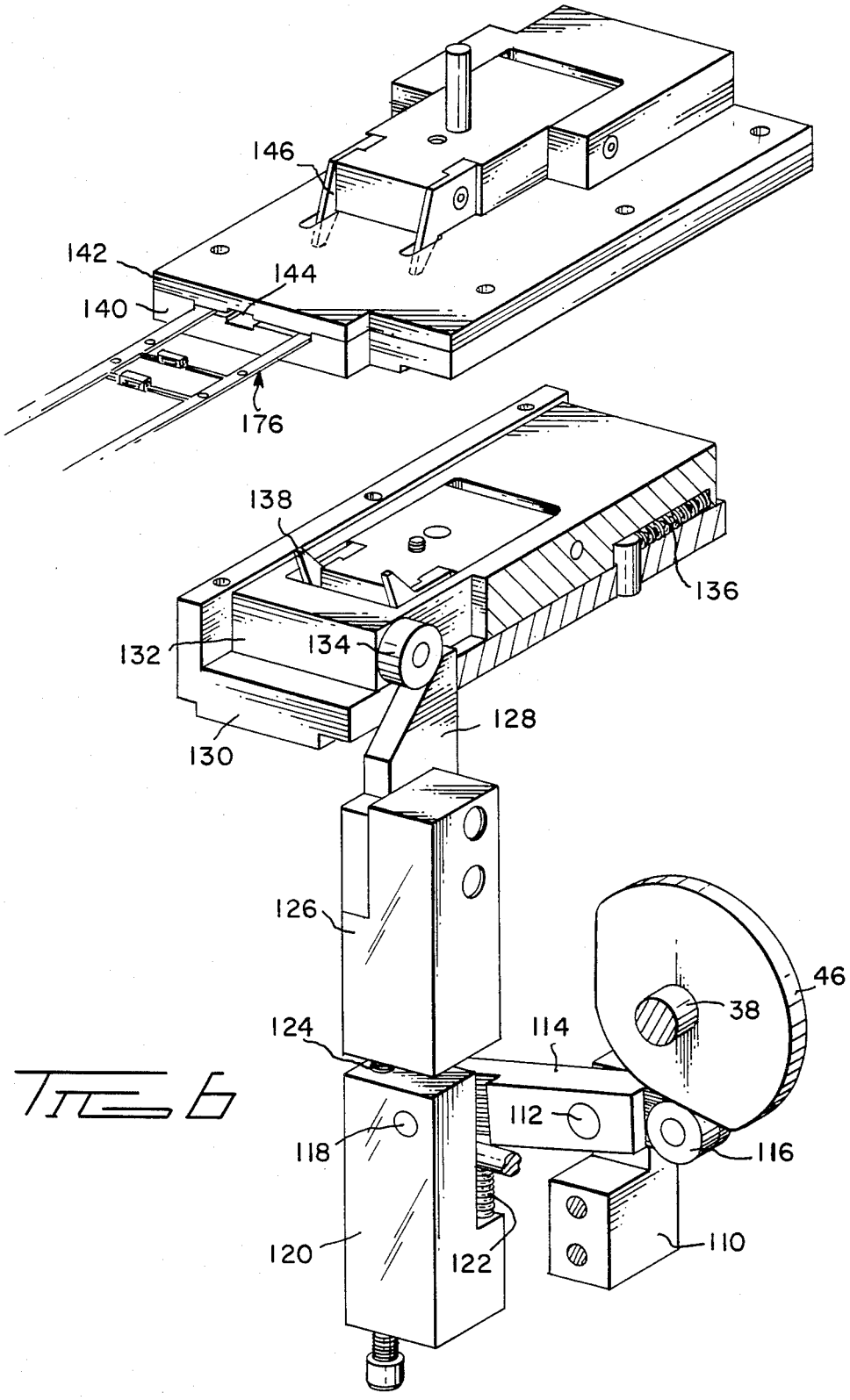
FIG. 6 is an exploded perspective view, partially in section, taken along lines 6—6 of FIG. 3.

The terminal feed means 26 is best seen in FIGS. 3 and 6 and includes the previously mentioned third cam 46 fixed to the drive shaft 38. A block 110 is fixed to the housing 30 and has a pivot pin 112 mounted therein with a lever 114 pivotably mounted on the pin 112 with a cam follower 116 on one end adapted to engage the cam 46 and a pin 118 at the opposite end connected to the lower block 120. The lower block is provided with a return spring means 122 and by an adjustment pin or screw 124 to the upper block 126 which has a cam 128 projecting from the upper end thereof. A fixed base plate 130 is secured to the housing 30 and has a slide 132 movably mounted therein with a cam follower 134 positioned to be engaged by the cam 128 and return spring means 136 to bias the slide so that the cam follower constantly engages the cam 128. The slide also carries a pair of feed pawls 138 which are pivotably mounted in the slide and spring loaded to project from the upper surface thereof. Neither the pivots for the pawls nor the spring bias means have been shown. A pair of lower and upper plates 140, 142, respectively, are secured to the base plate 130 and define therebetween a terminal strip passage 144. A pair of stop pawls 146 are pivotably mounted in the top plate 142 and spring biased to project into the passage 144. The spring means for the pawls are also standard and not shown.

The terminal stuffing means 28 (see FIGS. 2 and 5) includes the second cam means 42 secured to the drive shaft 38, a lever 148, pivotably mounted by a pin 150 fixed in the housing 30 with a cam follower 152 on a first end and a pin 154 on the opposite end connecting the lever 148 to one end of a link 156. The opposite end of the link 156 is connected by pin 158 to one arm of bell crank 160. The bell crank 160 is pivoted by a pin 162 which is fixed in the housing 30. The other arm of the bell crank 160 is connected by pin 164 to a slide assembly 166. The slide assembly 166 includes a spring biased stuffer arm 168 which is aligned to project into a slot 170 defined in the guide 172 and beneath the guide cover 174 (see FIG. 4).

The sequencing operation of the present invention will be described with reference to FIGS. 7 to 10 and a detailed explanation of operation will follow making reference to FIGS. 2 to 6.

Figure 7:
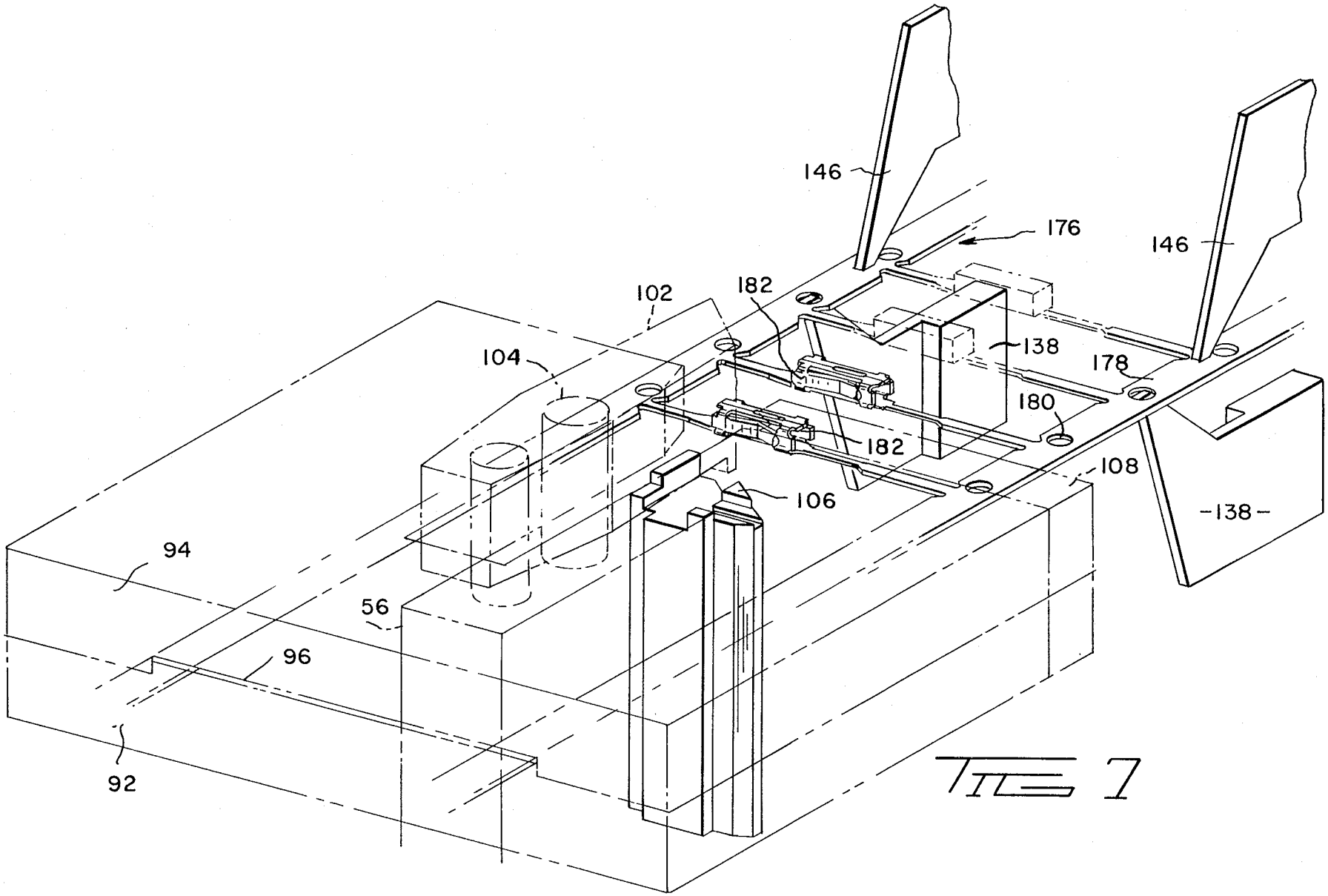
FIG. 7 is a diagrammatic representation of the subject invention during a feed stroke.
Figure 8:
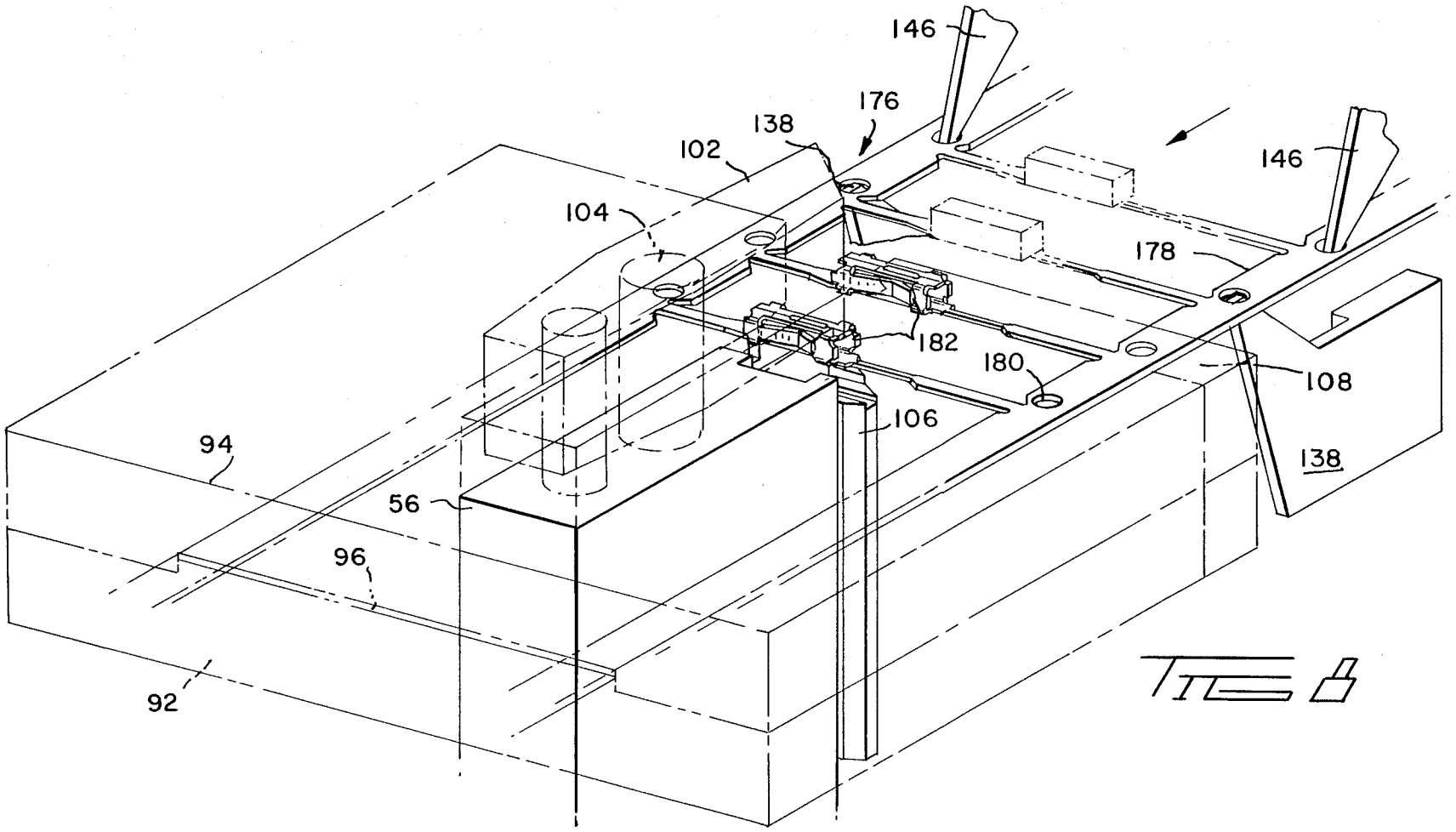
FIG. 8 is similar to FIG. 7 showing the subject invention after a terminal has been fed to the shear station.
Figure 9:
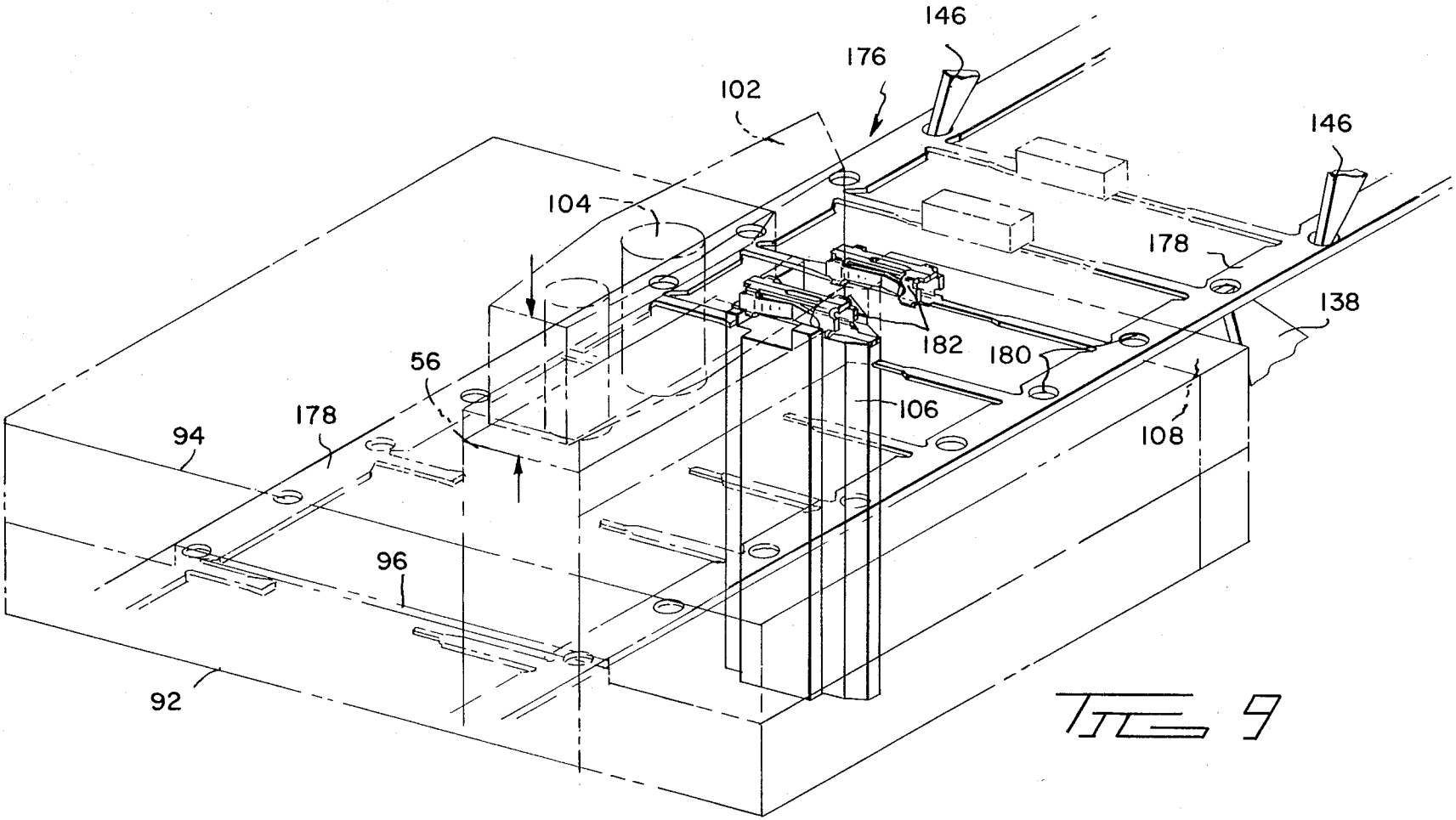
FIG. 9 is similar to FIGS. 7 and 8 showing the terminal after it has been sheared from the carrier strips.
Figure 10:
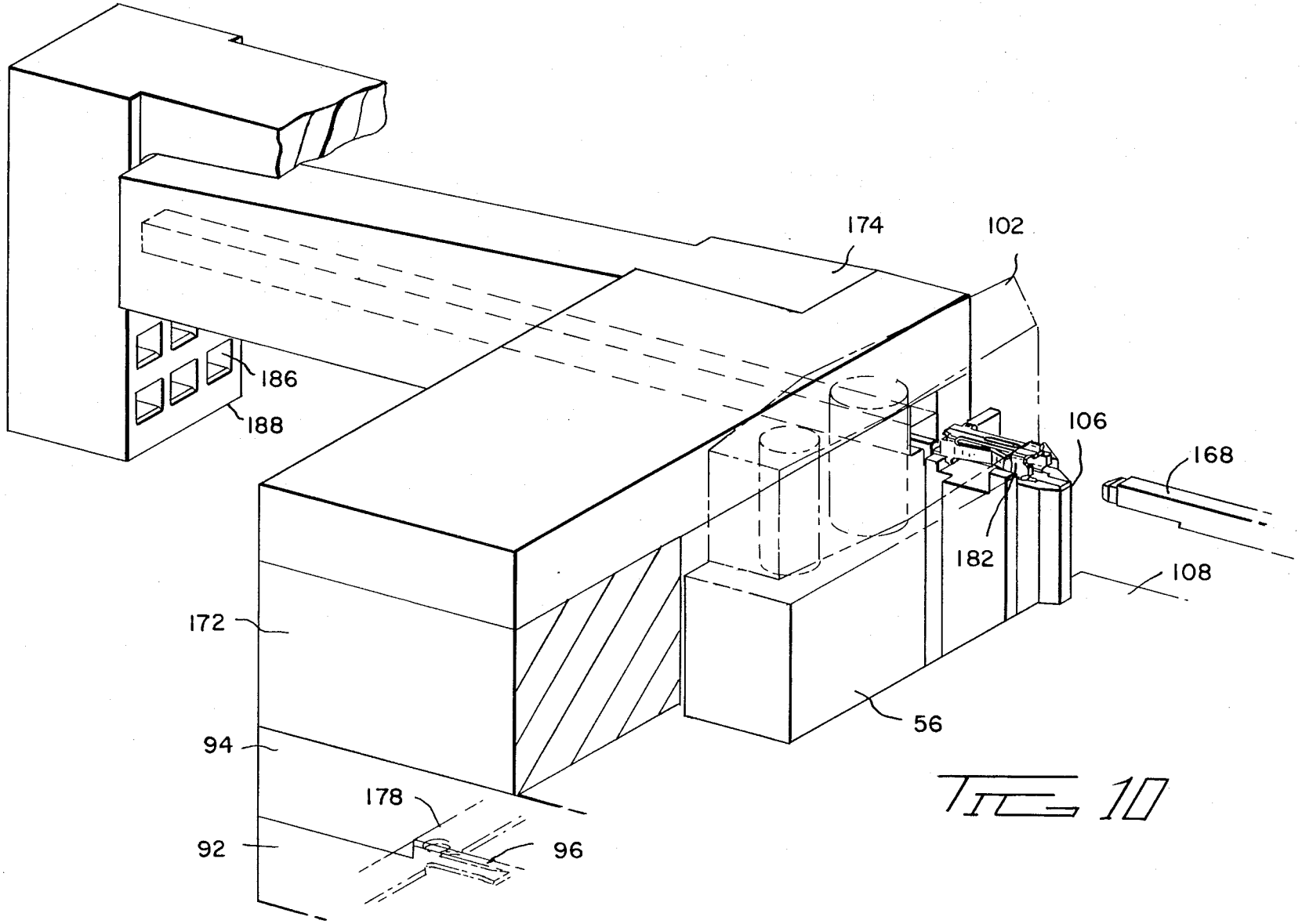
FIG. 10 is a diagrammatic representation of the subject modular insertion unit positioned to feed the severed terminal into an awaiting housing.

Referring now to FIG. 7, strip of terminals 176 is shown as it would be fed by the feed pawls 138 to the shear station. In this position the anti-back up or stop pawls 146 are riding on the carrier strips 178 while the feed pawls 138 are engaged in apertures 180 in the carrier strips 178 to move the terminal strip 176 forward. As the slide 132 starts its return trip, the anti-back up or stop pawls 146 engage in the next sequential apertures 180 to hold the terminal strip 176 against a reverse movement. The terminal 182 positioned in the shear station lies immediately above the shear blade 106 on the upper end of the top block 56. Upon actuation of the machine, the clamping plate 102, shown in phantom in FIG. 8, engages the top of the terminal 182 to prevent its upward movement. Simultaneously, the top block 56 commences to move upward bringing the shear blade 106 into engagement with the shear blade 108 on the top cutting plate 94. The terminal 182 is completely sheared from the carrier strip 178, as shown in FIG. 9 and carried further upwardly until it reaches the stuffing station shown in FIG. 10. The stuffer arm 168 then moves forward to drive the severed terminal 182 down the guide slot 170 and into the appropriate cavity 186 of the associated housing 188. The stuffer arm 168 is then retracted, the top block 56 retracted, and separated from the clamping plate 102 so that the terminal feed means 26 can sequence the next terminal 182 forward into the severing station.

Figure 2:
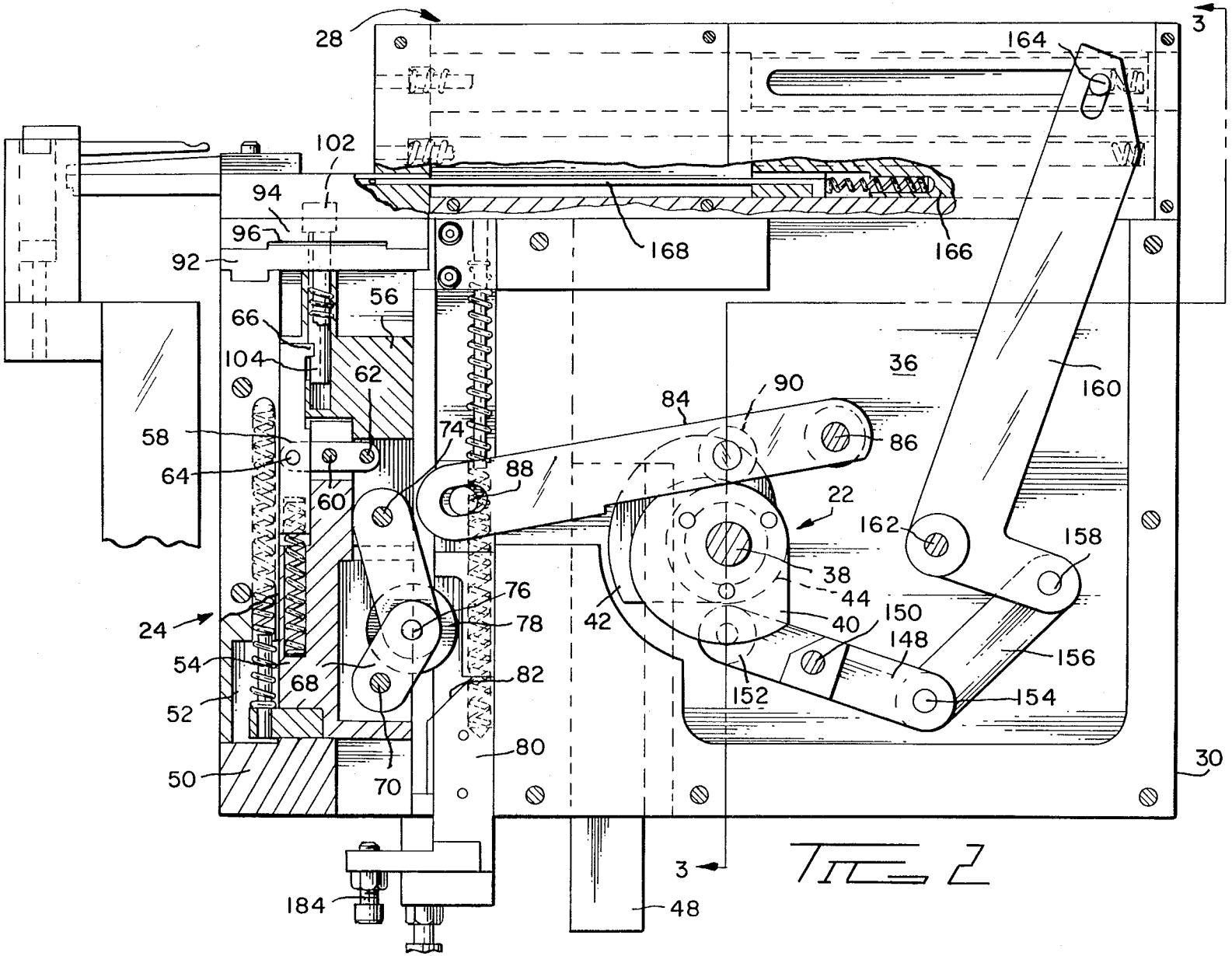
FIG. 2 is a side elevation, partially in section, of a modular insertion unit according to the present invention taken along line 2—2 of FIG. 3.
Figure 5:
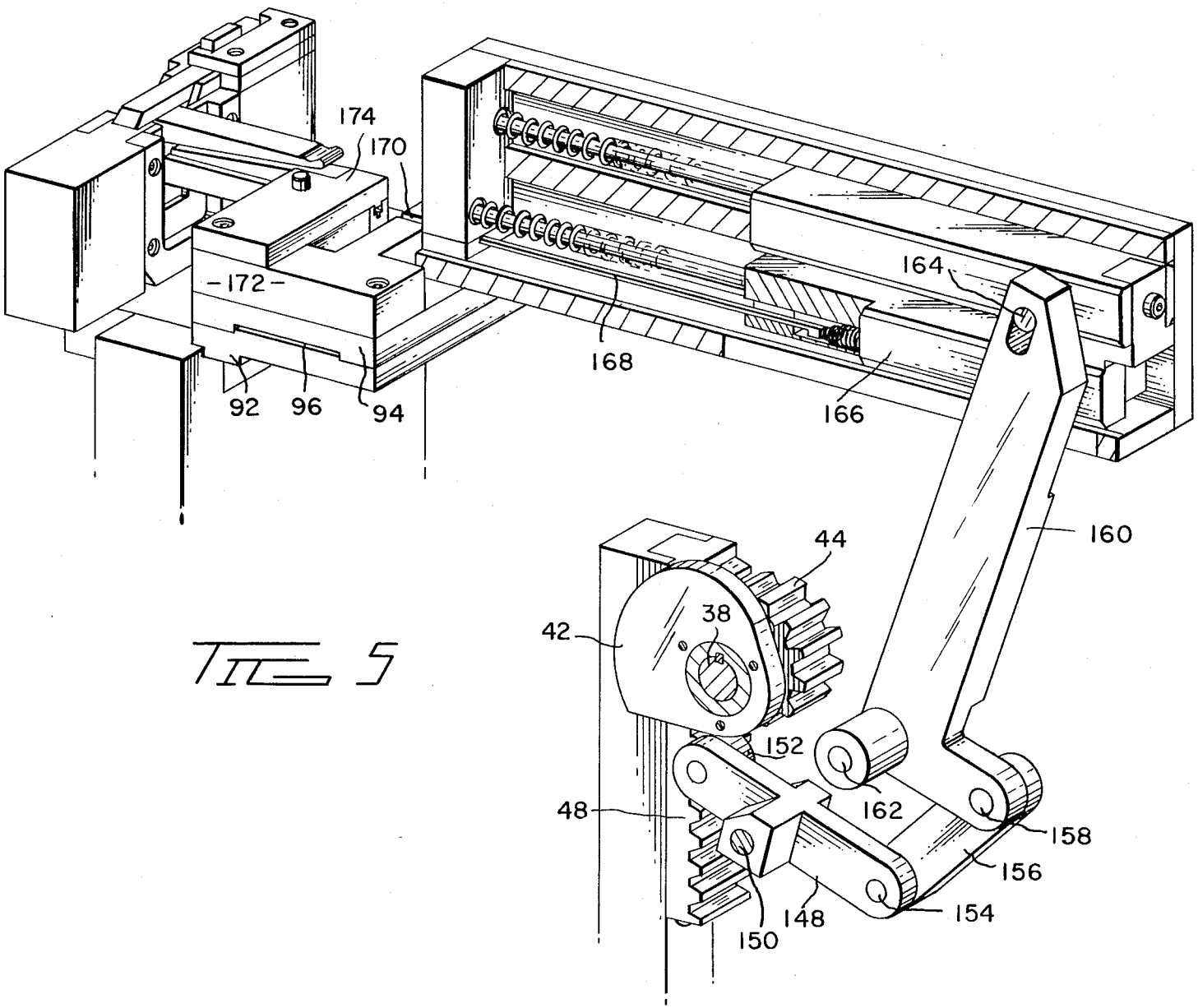
FIG. 5 is a perspective view, partially in section, taken along line 5—5 of FIG. 3.

The foregoing reciprocating actions are initiated by the reciprocating action of the rack 48, see FIGS. 2 and 5. As the rack 48 goes up, it will cause the shaft 38 to drive in a clockwise direction. This rotation causes the cams 40, 42 and 46 to rotate in a clockwise direction. The cam 40 has a surface which will be followed by the cam follower 90 causing the lever 84 to rotate in a counterclockwise direction about pivot 86 and pull the cam plate 80 in an upward direction. The upward movement of the cam plate 80 will bring the cam surface 82 into engagement with the cam follower 78 causing the links 68, 72 to straighten from the position shown in FIGS. 2 and 4. This straightening of the links 68, 72 causes the link 58 to rotate in a counterclockwise direction driving the top block 56 upward while pulling the pull member 66 downward so that it will engage the leg portion 104 of the clamping plate 102. The further rotation of the cam 40 will cause the lever 84 to continue to rise holding the cam surface 82 against the cam follower 78 so that the top block 56 will move upwardly to cause the shear blade 106 carried at the upper end of the top block 56 to act with the shear blade 108 on the top cutting plate 94 to shear the terminal 182 trapped between the clamping plate 102 and the top block 56 from the associated carrier strips 178. The further continued upward movement of the cam plate 80 will bring adjustment pin 184 into engagement with the bottom block 54 so that the bottom block 54 and top block 56 will move as a unit and cause the upper end of the top block 56 to drive the severed terminal 182 up to a position aligned with the guide slot 170 of the guide member 172 where it can be engaged by the stuffer arm 168.

The continued rotation of the drive shaft 38 eventually brings the second cam 42 into engagement with the cam follower 152 to cause the lever 148 to rotate in a counterclockwise direction. This counterclockwise movement of lever 148 causes a pushing motion on link 156 which translates as a counterclockwise rotation of the bell crank 160 about the pivot pin 162. The movement of the bell crank 160 causes the slide assembly 166 to move forward, to the left as shown, and the stuffer arm 168 to engage the terminal 182 and to drive the terminal forward through the slot 170 in the guide 172 into the proper cavity 186 awaiting housing member 188.

The clockwise motion of the drive shaft 38 also causes the third cam 46 to rotate in the clockwise direction so that its camming surface drives the cam follower 116 downward to impart a clockwise rotation of lever 114 about the pivot pin 112. This motion causes the block assembly 120, 126 to move upward so that the cam 128, in engagement with the cam follower 134, causes the slide 132 to move forward, to the left as shown in FIG. 6, so that the feed pawls 138 engage in the next sequential apertures 180 in the carrier strip 178 and drive the strip of terminals 176 forward so that the next sequential terminal 182 is positioned in the shear station.

The return movement of the rack 48, in a downward direction, will clearly cause a reversal of the above mentioned sequence of events. The return of the several parts to their initial position, as shown in FIG. 2, is assisted by the several springs that are shown and which have not been described in detail since their function is clearly known to the skilled artisan. In this respect it should be noted that the cam and spring arrangement shown can be further simplified and many of the illustrated springs obviated by substituting a box cam drive arrangement with the several levers being positively driven in each direction by box cam members.

The illustrated terminals 182 are fully described in U.S. Pat. Nos. Re. 26,646 and Re. 26,837 the disclosures of which are incorporated herein by reference. Clearly any similar strip formed or strip carried terminal may be substituted for the one illustrated with only minor dimensional modifications being required for the subject modular units.

The present invention may be subject to many modifications and changes without departing from the spirit or essential characteristics thereof. The present embodiment is therefore to be considered in all respects as illustrative and not restrictive of the scope of the invention.

What is claimed is:

1. In an assembly machine for sequentially inserting electrical terminals into respective cavities of connector housings, said assembly machine having a power source, a connector housing feed and indexing means, and a terminal strip feed path, at least one modular insertion unit, each said unit comprising:

a housing adapted to be selectively positioned on said assembly machine along said feed path for said terminal strip;

drive means within said housing adapted to connect said modular unit to be driven by said power source of said machine, said drive means having a drive shaft rotatably mounted in said housing, means connecting said drive shaft to said power source to impart alternate rotary motion to said shaft, first cam means secured to said shaft, means connecting said first cam means to impart motion to said terminal feed means, second cam means secured to said shaft, means connecting said second cam means to impart motion to said terminal severing means, third cam means secured to said shaft, and means connecting said third cam means to impart motion to said terminal stuffing means;

said means connecting said first cam means to impart motion to said terminal feed means having a lever pivotally mounted intermediate its ends;

a cam follower on one end of said lever engaging said first cam; and cam means on the opposite end of said lever to convert the rotary motion of said first cam to a linear motion to feed said terminal strip;

terminal feed means powered by said drive means to feed a strip of terminals to a severing station within said modular unit;

terminal severing means at said severing station including clamping means adapted to hold the terminal in position while severing it from associated carrier strips and to subsequently move the clamped terminal to a stuffing station, and means at said stuffing station to drive said terminal into a respective cavity of an associated connector housing.

2. A modular insertion unit according to claim 1 wherein said means connecting said drive shaft to said power source is a rack driven longitudinally with reciprocal motion and a gear fixed to said drive shaft and engaging said rack.

3. A modular insertion unit according to claim 1 wherein said means connecting said second cam means to impart motion to said severing means comprises:

a lever pivotally mounted at one end;

a cam follower intermediate the ends of said lever engaging said second cam; and a cam plate attached to the other end of said lever whereby rotary motion of said second cam is converted to linear motion of said shear means.

4. A modular insertion unit according to claim 1 wherein said means connecting said third cam means to impart motion to said terminal stuffing means comprises:

a lever pivotally mounted intermediate its ends;

a cam follower attached to one end of said lever engaging said third cam;

lever means attached to the other end of said lever converting the rotary motion of said third cam to a linear movement of said stuffer means.

5. A modular insertion unit according to claim 1 wherein said terminal feed means comprises:

an extension of said housing directed toward a dereeling mechanism;

slide means movably mounted within said extension and defining a terminal feed path therebetween;

feed pawls mounted on said slide means biased to extend into said terminal feed path;

stop pawls mounted on said extension biased to extend into said terminal feed path;

means connected to said drive means to impart a reciprocal motion to said slide means whereby terminals are fed one at a time to said severing station by said feed pawls during forward motion of said slide and held against withdrawal by said stop pawls during rearward motion of said slide.

6. A modular insertion unit according to claim 5 wherein said means connected to said drive means comprises:

a drive shaft of said drive means having a first cam mounted thereon;

a lever pivotally mounted intermediate its ends;

a cam follower on one end engaging said first cam; and cam means on the opposite end engaging said slide means whereby the rotary motion of said first cam is converted to a linear motion of said slide to feed said terminal strip.

7. A modular insertion unit according to claim 1 wherein said terminal severing means comprises:

top shear blade means fixed above a terminal in said severing station;

a bottom shear blade means adapted to engage the underside of said terminal in said severing station;

clamp means adapted to clamp said terminal in said severing station against said bottom shear blade means for movement therewith; and means to drive said bottom shear blade means with respect to said top shear blade means whereby said terminal in said shear station is clamped to said bottom shear blade means, sheared from its carrier strips by interaction of said top and bottom shear blade means and carried to said stuffing station.

8. A modular insertion unit according to claim 1 wherein said terminal stuffing means comprises:

guide means defining a guide slot leading to a cavity of a housing;

a stuffer arm; and means to actuate said stuffer arm to drive a terminal down said slot into said cavity.

9. A modular insertion unit according to claim 8 wherein said means to actuate said stuffer arm comprises:

a drive shaft of said drive means having a third cam mounted thereon;

a lever pivotally mounted intermediate its ends;

a cam follower attached to one end of said lever engaging said third cam;

lever means attached to the other end of said lever converting the rotary motion of said third cam to a linear movement driving said stuffer arm down said guide slot.

10. In an assembly machine for sequentially inserting electrical terminals into respective cavities of connector housings, said assembly machine having a power source, a connector housing feed and indexing means, and a terminal strip feed path, at least one modular insertion unit, each said unit comprising:

a housing adapted to be selectively positioned on said assembly machine along said feed path for said terminal strip;

drive means within said housing adapted to connect said modular unit to be driven by said power source of said machine;

terminal feed means powered by said drive means to feed a strip of terminals to a severing station within said modular unit;

terminal severing means at said severing station including clamping means adapted to hold the terminal in position while severing it from associated carrier strips and to subsequently move the clamped terminal to a stuffing station, said severing means having top shear blade means fixed above a terminal in said severing station, a bottom shear blade means adapted to engage the underside of said terminal in said severing station, clamp means adapted to clamp said terminal in said severing station against said bottom shear blade means for movement therewith, and means to drive said bottom shear blade means with respect to said top shear blade means whereby said terminal in said shear station is clamped to said bottom shear blade means, sheared from its carrier strips by interaction of said top and bottom shear blade means and carried to said stuffing station; and means at said stuffing station to drive said terminal into a respective cavity of an associated connector housing.

11. A modular insertion unit according to claim 10 wherein said bottom shear blade means comprises:

top and bottom blocks;

a link pivotally connected intermediate its ends to said bottom block and at one end to said top block;

said clamp means being connected to the other end of said link;

means connected to said drive means to impart initial motion to said top block, causing said link to rotate drawing said clamp means against said top block, said top block, bottom block and clamp means moving thereafter as a unit.

12. A modular insertion according to claim 11 wherein said means connected said drive means to impart motion to said severing means comprises:

a drive shaft of said drive means having a second cam mounted thereon;

a lever pivotally mounted at one end;

a cam follower intermediate the ends of said lever engaging said second cam;

a cam plate attached to the other end of said lever; and an articulated cam follower means having one end connected to said top block and the other end connected to the bottom block and in engagement with said cam plate whereby rotary motion of said second cam is converted to linear motion of said top and bottom blocks with the former commencing movement in advance of the latter causing movement of said clamping means into clamping position on said bottom block.

13. A modular insertion unit according to claim 10 wherein said top shear blade means comprises:

a pair of plates defining a terminal strip feed channel therebetween aligned with the terminal strip feed means; and a shear blade carried by the one of said plates.

* * * * *